US005103998A

United States Patent [19]

Caro et al.

[11] Patent Number: 5,103,998

[45] Date of Patent: Apr. 14, 1992

[54] MULTI-COMPARTMENT RECYCLING CONTAINER

[76] Inventors: Dolly Caro, 3 Darien Pl.; Arlene Siegel, 38 Lorijean La., both of East Northport, N.Y. 11731

[21] Appl. No.: 607,301

[22] Filed: Oct. 31, 1990

Related U.S. Application Data

[63] Continuation-in-part of Ser. No. 533,804, Jun. 6, 1990, abandoned.

[51] Int. Cl.[5] ..... B65D 25/08

[52] U.S. Cl. ..... 220/533; 220/531; 220/909; 220/532

[58] Field of Search ..... 220/531, 533, 532, 530, 220/909

[56] References Cited

U.S. PATENT DOCUMENTS

| | | | |
|---|---|---|---|
| 2,175,949 | 10/1939 | Allen | 220/533 |
| 2,788,912 | 4/1957 | Simonsen | 220/533 |
| 2,843,131 | 7/1958 | Wolters | 220/531 |
| 3,491,909 | 1/1970 | Ikelheimer | 220/533 |
| 4,114,776 | 9/1978 | Pluss | 220/531 |
| 4,746,015 | 5/1988 | Kaucic | 220/533 |
| 4,776,482 | 10/1988 | Wolters et al. | 220/531 |
| 4,867,328 | 9/1989 | McCarthy | 220/533 |
| 4,976,375 | 12/1990 | Quam | 220/531 |
| 4,978,018 | 12/1990 | Wood | 220/531 |
| 5,014,868 | 5/1991 | Wittig et al. | 220/531 |

FOREIGN PATENT DOCUMENTS

| | | | |
|---|---|---|---|
| 8300820 | 10/1984 | Netherlands | 220/909 |

*Primary Examiner*—Stephen Marcus
*Assistant Examiner*—S. Castellano
*Attorney, Agent, or Firm*—Alfred M. Walker

[57] ABSTRACT

A multi-compartmental recycling container has symmetrical front and back walls, joined to partition walls for purposes of creating compartments for the storage of recyclable materials prior to collection by authorized agencies, which partition walls have flexible joining member reciprocating with corresponding nodules on the interior face of the front and back walls of the container.

1 Claim, 6 Drawing Sheets

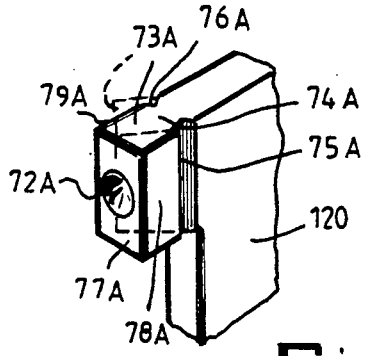
Fig. 11
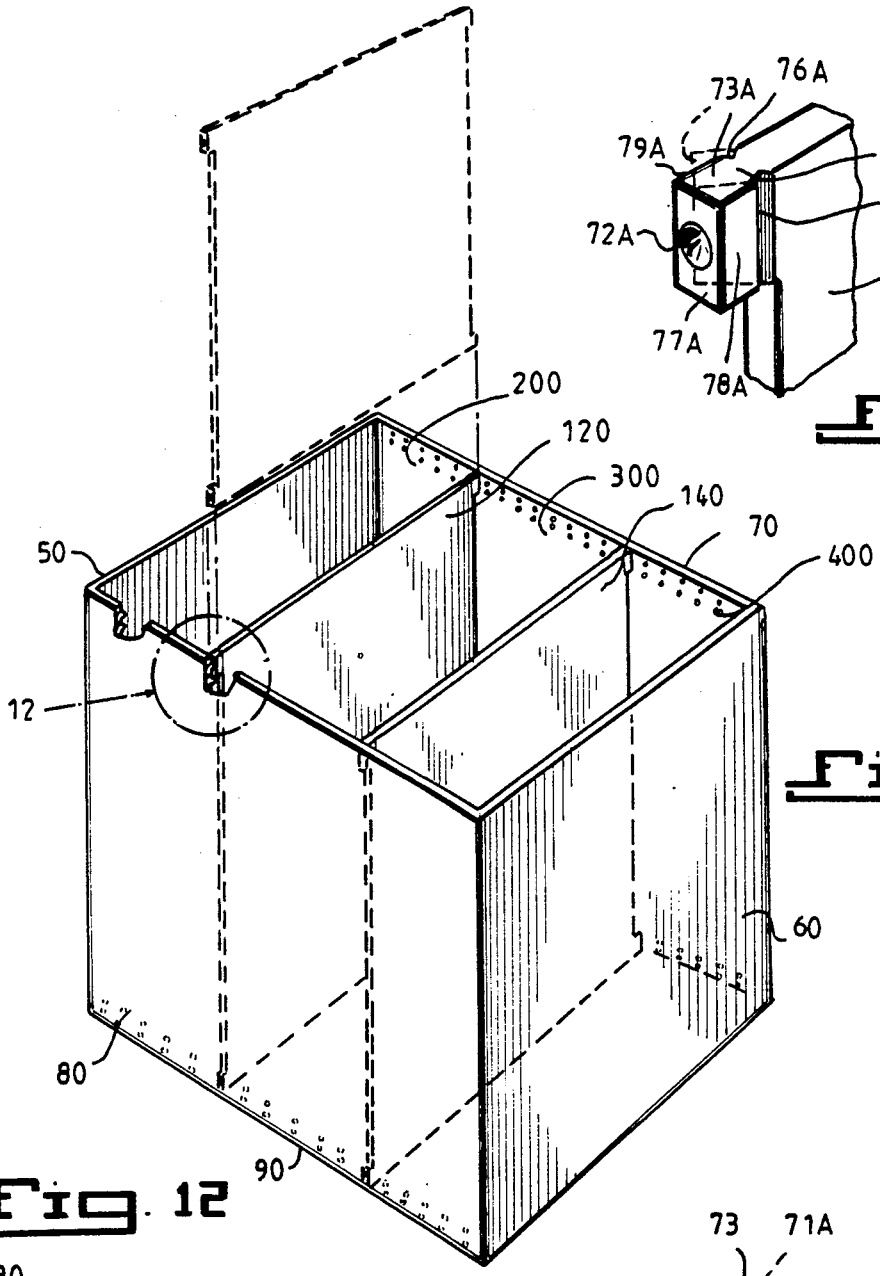
Fig. 10
Fig. 12
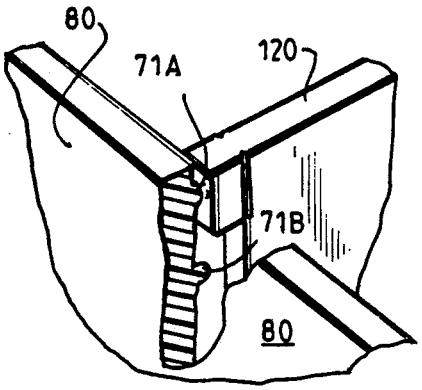
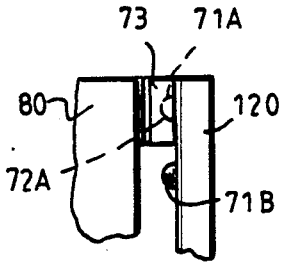
Fig. 13

MULTI-COMPARTMENT RECYCLING CONTAINER

BACKGROUND OF THE INVENTION

This application is a Continuation-In-Part of application Ser. No. 07/533,804, filed June 6, 1990, now abandoned.

The present invention relates to a multi-compartment recycling container. In particular, the present invention relates to providing individual storage compartments in a household for glass, paper and metal objects prior to recycling by the appropriate government-licensed agency.

PRIOR ART

Apparatus used as trash containers are known in the art. However, the recent passage of state and local governmental laws requiring mandatory recycling makes the earlier art obsolete and/or requires a multiplicity of trash containers.

The prior art does not permit the ready storage of objects in adjustable containers for the purposes of recycling.

THE PRESENT INVENTION

It is an object of the invention to provide for recycling container which is grooved in order to accommodate a plurality of compartments for the temporary storage of glass, metal and paper objects.

A further object is to afford the user an easy means to segregate the stated refuse without using multiple containers.

A still further object is to render the unit movable by the placement of an optional set of casters on the bottom of the unit and/or to attach optional handles on the front wall and two side walls. Such slidability permits its storage under a cabinet or in a garage, or other such facility.

It is also an object of the present invention to provide for adjustable flexibility in storage space by providing for grooved units in the front and back walls to accommodate partitions, thereby creating separate compartments. Said partitions may be spaced to afford more or less storage space for various objects as the need arises.

It is a further object of the invention to provide for a recycling container with adjustablely sized compartments the location of whose walls can be rapidly changed with ease and convenience.

It is a further object of the present invention to provide for removable separate compartments which are adjustable in volume, by manually adjusting the width of the compartments.

SUMMARY OF THE INVENTION

The present invention overcomes the disadvantages of the prior art containers by making it possible to segregate recyclable objects in different compartments of the same unit. This invention eliminates the confusion that is caused by the use of multiple containers; this invention provides for a savings in the space used to store the recyclable material.

The recycling container includes parallel front and back walls, symmetrical in size, joined to parallel walls on the left and right sides, also symmetrical, by an interlocking device. The walls may be constructed of metal, plastic or fiberglass material.

In the preferred embodiment, the parallel interior walls are removably attached to the interior of two of the four outer walls by means of a flexible joining socket mean into which is inserted one of a series of rounded flexible nodules, which nodules are evenly spaced across the inner walls of the four container walls.

In another embodiment, the inside front and back walls contain a weries of grooves designed to accommodate walled partitions to create variable sized compartments to segregate the recyclable material. When properly aligned in the grooves in the front and back walls, the partitions slide into place. The placement of said partitions may be adjusted at the user's discretion and/or usage need.

The bottom part of the unit is a solid base made up of the same material as in the front and back walls and the side walls.

In a second embodiment, the partitions to be placed inside of the container are able to fit securely into the grooves inside of the front and back walls. Said partitions may be adjusted by manual lifting from the grooved receptacles and then placing them into a different set of corresponding grooves.

In another further embodiment, the compartments are self contained, and removable with adjustably sized base members to adjust the volume of the containers.

The container may be equipped with handles and/or casters to permit its ready transportation from one location to the next, principally for purposes of recycling collection by the authorized recycling agent.

The invention itself will be best understood when a preferred embodiment of the invention is described with reference to the accompanying drawings.

BRIEF DESCRIPTION OF THE DRAWINGS

FIG. 10 is a perspective view of another embodiment of the invention.

FIG. 11 is a close up perspective view of the attaching socket of the device as shown in FIG. 10.

FIG. 12 is a further close up perspective view of the attaching socket and reciprocal nodule of the fastening means of the device, as shown in FIG. 10.

FIG. 13 is a close side view of the fastening means of the device as shown in FIG. 10.

DESCRIPTION OF THE INVENTION

Figure 1:
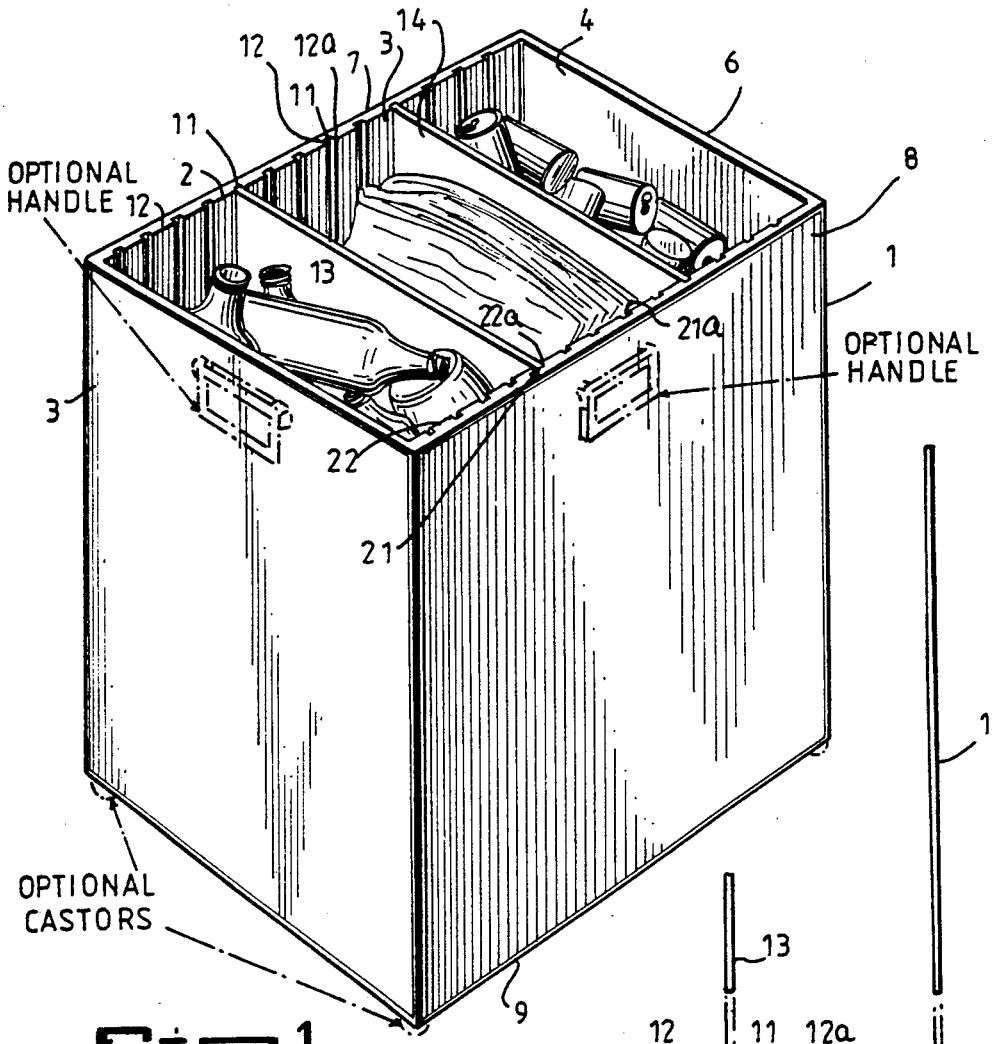
FIG. 1 is a perspective view of the multi-compartmental recycling container in accordance with the teachings of the present invention, with a display of recyclable objects in the three compartments, and with optional casters and optional handles.

Attention is directed to FIG. 1 which shows an embodiment of the invention. The present invention is a multi-compartmental recycling container. It is designed to facilitate the expeditious segregation of recyclable objects without the use of multiple containers.

Figure 2:
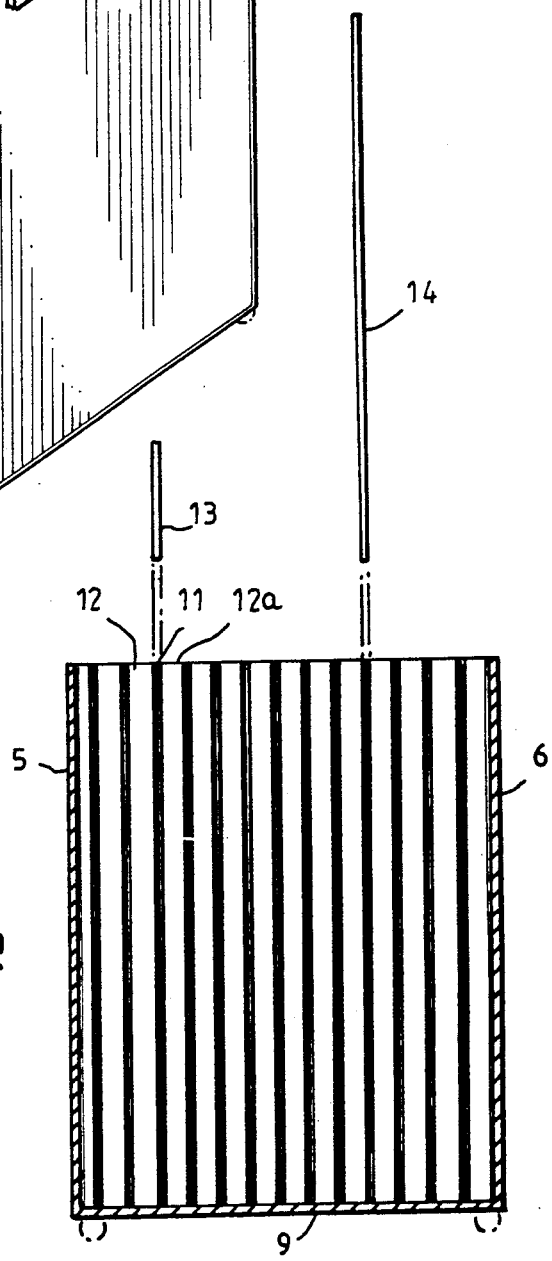
FIG. 2 is a side elevational view of the symmetrical front and/or back wall with particular emphasis on the grooves designed to receive the partitions, shown in side elevational view from the side.
Figure 3:
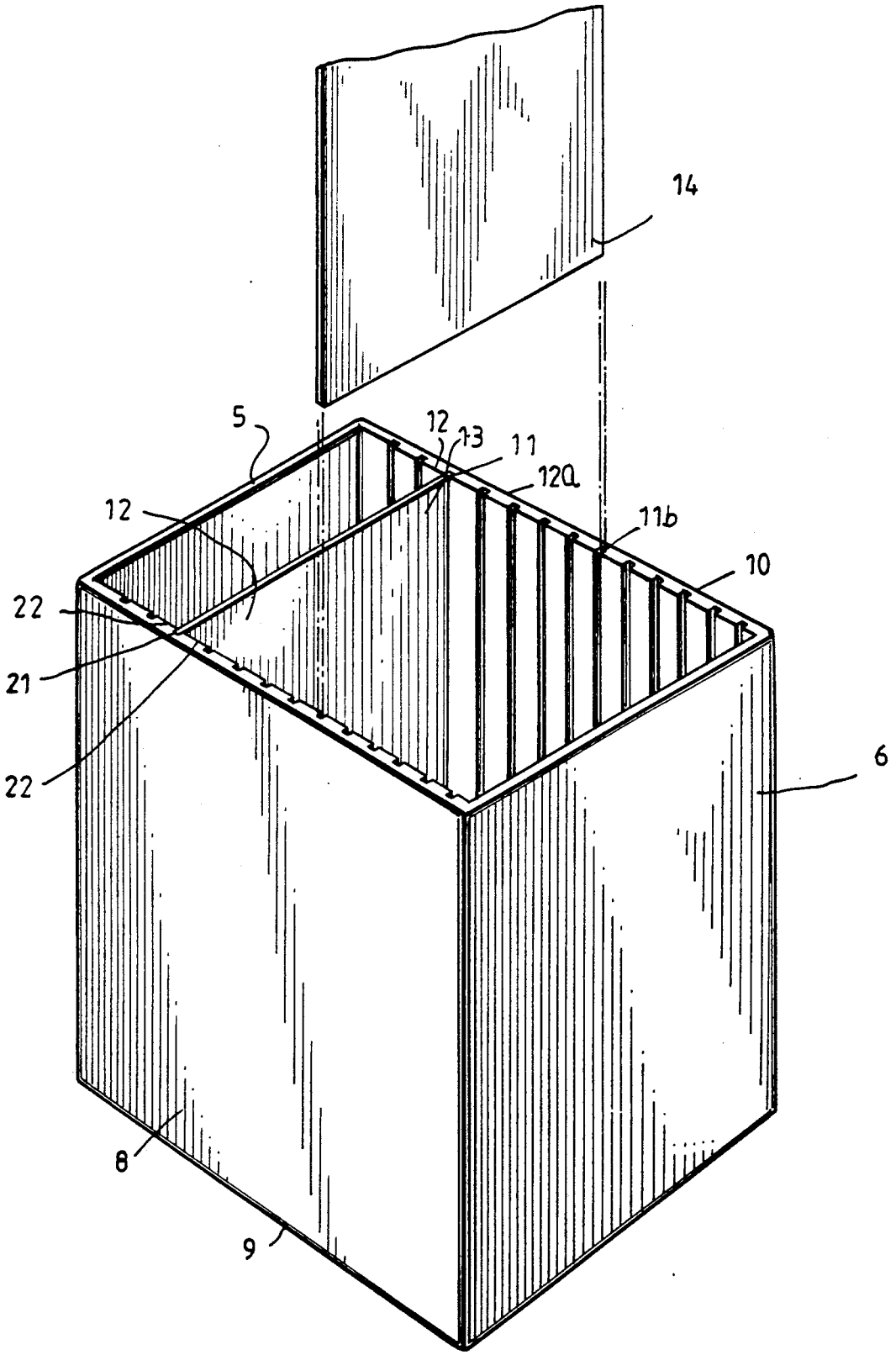
FIG. 3 is a perspective view of the multi-compartmental recycling container, with a perspective view of a partition insertable into the grooved receptacles.

In one embodiment of the device as shown in FIGS. 1, 2, and 3, the container generally includes rear and front walls 7 and 8 joined to sidewalls 5 and 6 upon base 9.

Front wall 8 and back wall 7 contain grooved receptacles 11, 11*a*, 11*b*, etc. and 21, 21*a*, 21*b*, etc. respectively. Grooved receptacles 11 and 11*a* and 21 and 21*a* are separated by holding abutments 12 and 22 respectively.

A partition, such as 13, fits into pairs 11 and 21 of the said grooved receptacles in parallel alignment between front wall 8 and back wall 7, and said partitions 13 and 14 are held in place by pairs of holding abutments between the grooved receptacles.

With placement of the partitions within container 1, separable compartments 2, 3 and 4 are created. Optional handles may be placed in side walls 5 and 6.

Partitions 13 and 14 slide into grooved receptacles in parallel alignment between the front wall 8 and back wall 7; the grooved receptacles terminate at base 9 of front wall 8 and back wall 7.

Compartments 2, 3 and 4 may be adjusted in size by varying the placement of partitions 13 and 14 into the interlocking parallel grooved receptacles found in front wall 8 and back wall 7.

Figure 4:
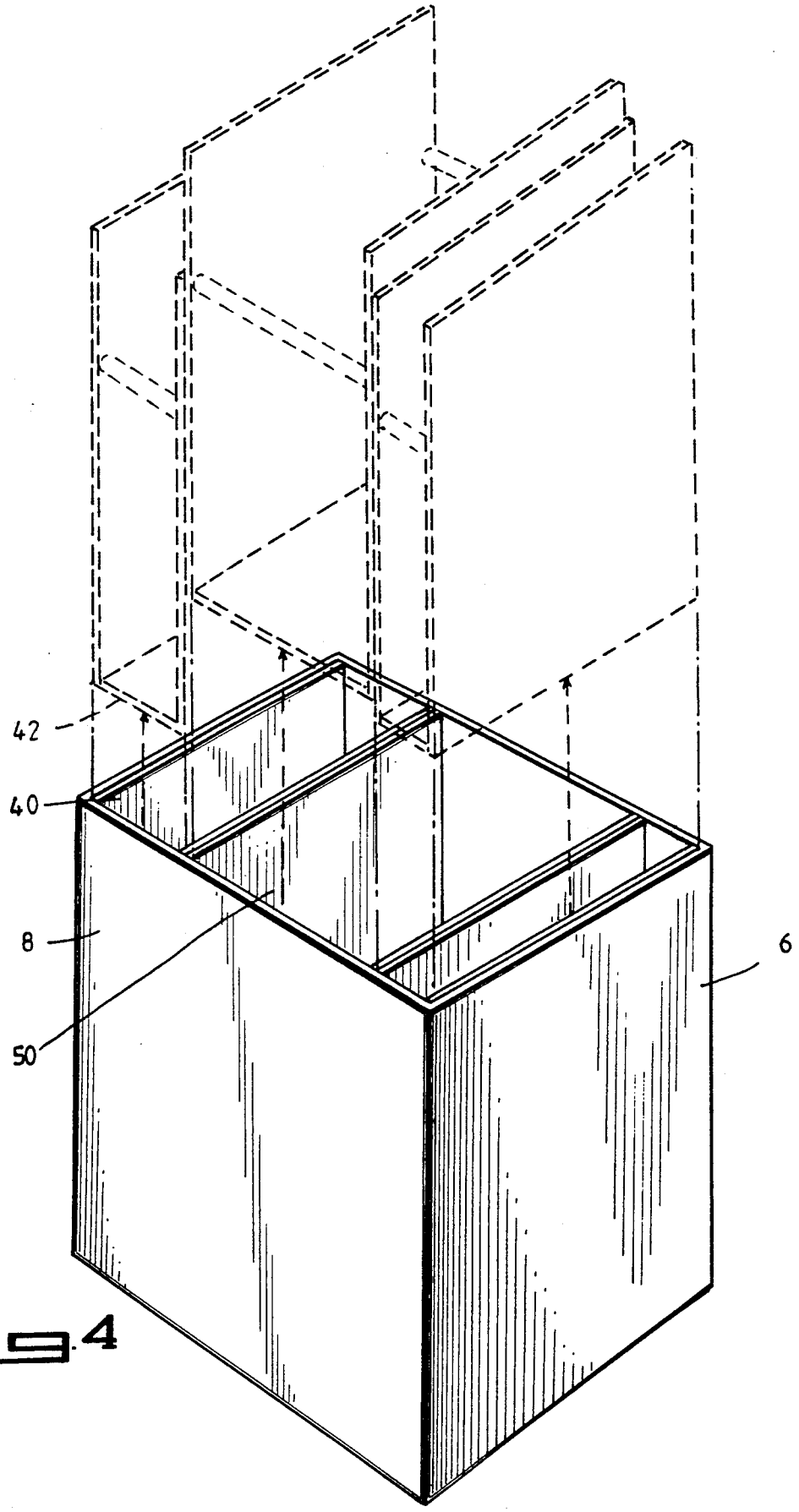
FIG. 4 is a perspective view of another embodiment of the multi-compartmental recycling container showing removable compartments in dotted lines.

FIG. 4 is an alternate embodiment of another version of the device wherein each compartment is separable from the other compartment units. The compartment 40 has a base portion 42 which is interlockingly disposed to parallel upwardly extending walls 41 and 41*a*. This results in detachable container units which may be removed for easy disposal of the recyclable waste material within each container.

Figure 5:
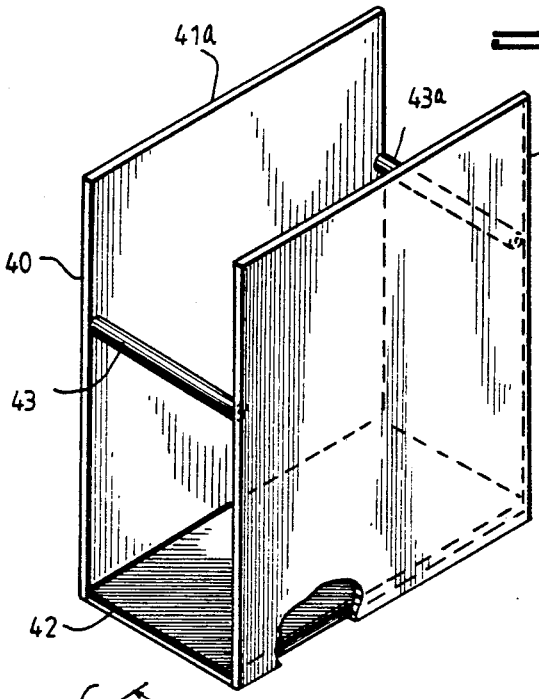
FIG. 5 is a perspective view of one removable compartment.
Figure 6:
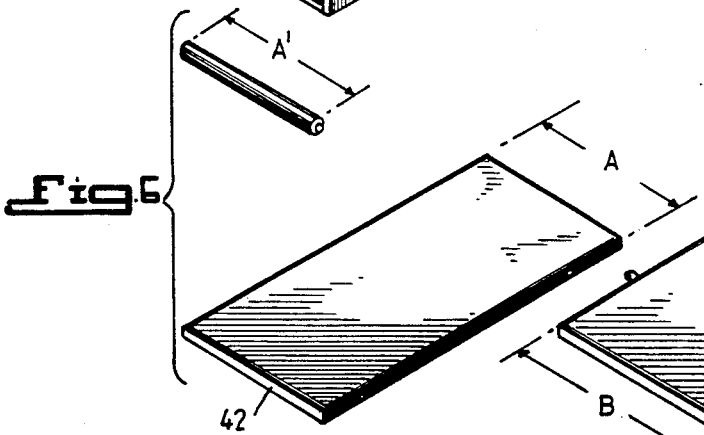
FIG. 6 is a perspective closeup view of one part of the base of the container with an interlocking beam in the front of the container to adjoin the sidewall and partition.
Figure 7:
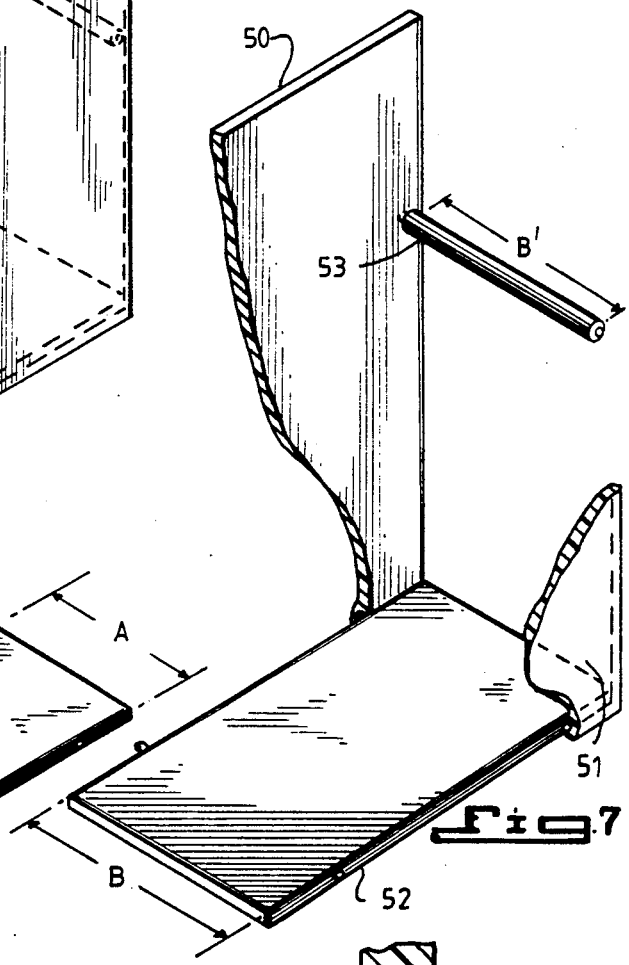
FIG. 7 is another perspective closeup view of part of the device.

The separable compartments designated in FIGS. 5, 6 and 7 as 40 and 50 respectively are adjustable at their base. The upwardly extending walls 41 and 41*a* are joined by cross beams 43 and 43*a* to provide structural support and to act as a handle for transporting the separable unit compartment 40.

According to this embodiment as shown in FIGS. 4–9 the compartments may be made of various sizes. For example, for a person who uses more glass than metal, the person can make a larger container with the larger base 52 which has a larger width B than base 42 having a smaller width A.

The size of cross beams 43 and 53 respectively equal the width of bases 42 and 52 having widths "A" and "B" for compartments 40 and 50 respectively.

Should the user wish to make a third compartment, another variable base (not shown) may be used to make three compartments.

In each of the two or more containers the length is constant to accommodate the length of container 1.

Cross beams 43 and 43*a* intersect upwardly extending walls 40 and 41 at a point generally higher than one half of the vertical height of said walls 40 and 41, thereby retaining the base portion 42 with upwardly extending walls 40 and 41 in a secure fit. The upwardly extending walls therefore comprise a separable compartment having parallel walls within which the user ma place plastic or paper bags or the like.

Figure 9:
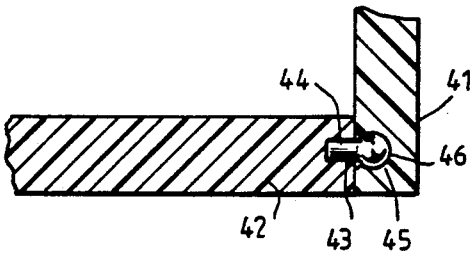
FIG. 9 is a closeup cross sectional view of the interlocking portion of the device.
Figure 8:
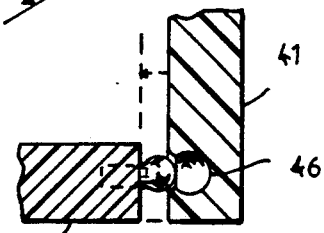
FIG. 8 is a closeup cross sectional view of the interlocking portion of the device.

As shown in FIGS. 8 and 9 a sub-assembly for interlocking base portion 42 with sidewalls 40 and 41 is shown in cross section. The interlocking means comprises a flexible knob portion 45 which is fittingly interlocking with cavity portion 46 such that the surface of the inner wall of cavity 46 corresponds to the exterior surface of knob 45.

Similar interlocking sub-assemblies are used to attach and detach cross beams 43 and 43*a* to upwardly extending walls 41 and 41*a*.

Base portion 42 is joinable at the lower surface of extension walls 41 and 41*a* so as to form a corner fit, generally at right angles.

Because of the flexible nature of knob portion 45, the pieces can be easily assembled and disassembled by the user to vary the width of the base portions 42 and 52, thereby adjusting the volumes of containers 40 and 50 respectively.

The sub-assemblies comprises the knob and cavity form an intersecting socket assembly for a secure and close fit in the corners of compartments 40 and 50 respectively as well as at the portions of the plane surface of upwardly extending walls 41 and 41*a* where cross beams 43 and 43*a* intersect said walls.

The sub-assemblies provide for expeditious disassembly from the other units in a snap-like manner.

As shown in FIG. 4 the units are removable from the container 1 in a separably removable in an upward notion.

Shown in FIGS. 10–14 is the preferred embodiment of the invention, namely a multi-compartmental recycling container with adjustable, quick release walls.

The container generally includes rear and front walls 70 and 80 joined to sidewalls 50 and 60 upon base 90.

Rear wall 70 and front wall 80 contain a plurality of flexible nodules 71 A, B, C, D etc. across the inside surfaces of walls 80 and 70. Grooved socket receptacles 72 A, B, C, D etc. are provided for interlocking with flexible nodules 71 A, B, C, D respectively. Receptacles 72 A, B, C and D are attached to removable walls 120 and 140 by means of flexible extensions 73 A, B, C, D with hinge means 74 A, B, C, D formed by opposing pairs of side vertical indentations 75 A, B, C, D and 76 A, B, C, D to facilitate flexible horizontal partial rotation of flexible extensions 73 A, B, C, D to permit easy interlocking of nodules 71 A, B, C, D within receptacles 72 A, B, C, D. Flexible extensions 73 A, B, C, D have front face ends 77 A, B, C, D indented by receptacles 72 A, B, C, D which receptacles are fitably disposed to corresponding nodules 71 A, B, C, D extending from said outer walls 70 and 80.

Extensions 73 A, B, C, D have pairs of opposite walls 78 A, B, C, D and 79 A, B, C, D, which extend rearward from said front face ends 77 A, B, C, D. Each of said opposite walls 78 A, B, C, D and 79 A, B, C, D have corresponding vertical grooves 75 A, B, C, D and 76 A, B, C, D at an end away from said front face ends 77 A, B, C, D. Said opposite walls 78 A, B, C, D and 79 A, B, C, D are joined to said outer walls 80 and 70 at a point adjacent to said grooves 75 A, B, C, D and 76 A, B. C, D With placement of the partitions 120 and 140 within container 1, separable compartments 200, 300 and 400 are created.

Optional handles may be placed in side walls 50 and 60.

Partitions 120 and 140 slide in parallel alignment between the front wall 80 and back wall 70.

Compartments 200, 300 and 400 may be adjusted in size by varying the placement of partitions 120 and 140 within front wall 80 and back wall 70.

Figures 14, 14A, 14B, 14C:
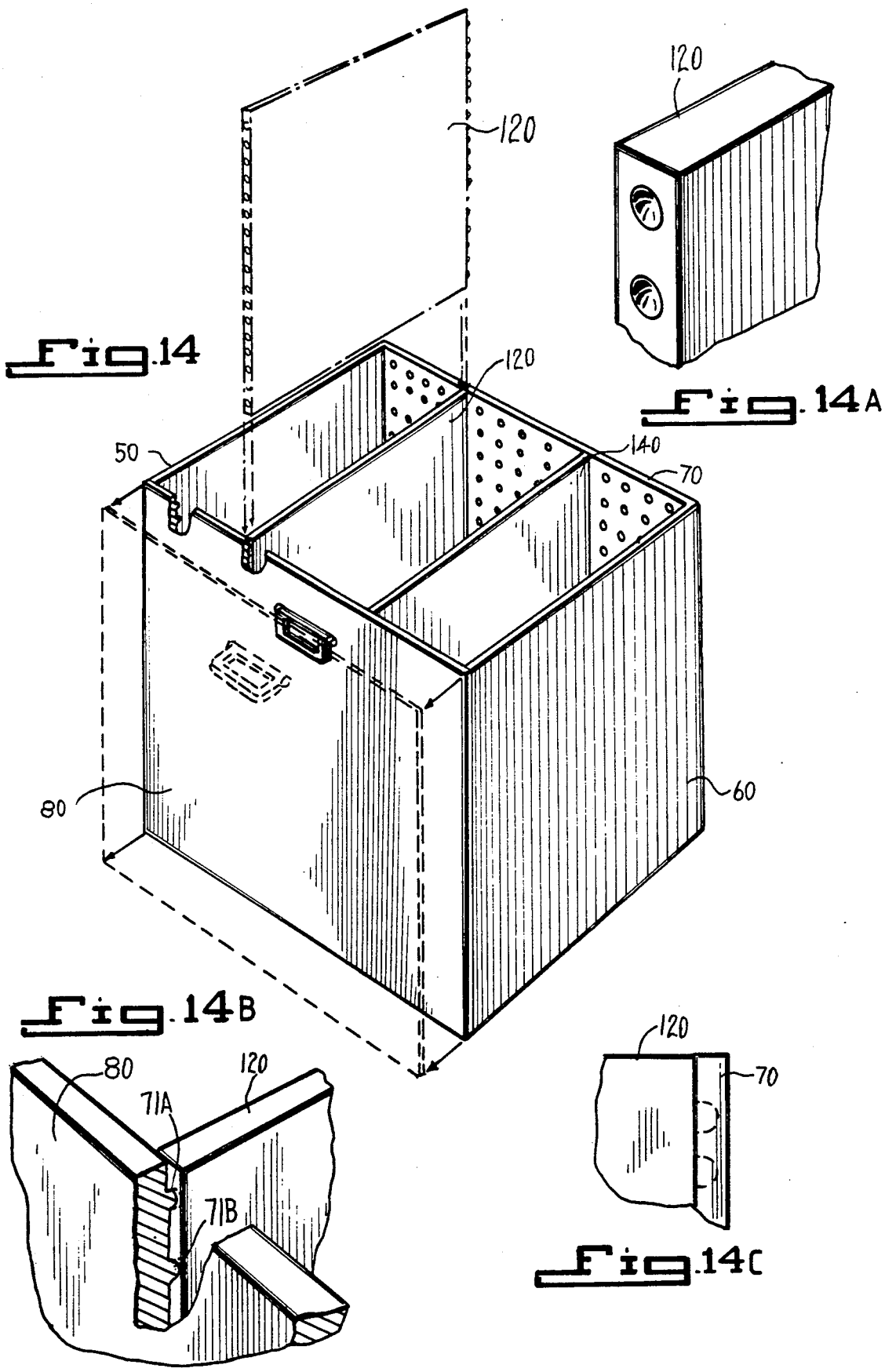
FIG. 14 is a perspective view of the device with a removable cover.
FIG. 14A is a close-up view of the device as shown in FIG. 14.
FIG. 14B is a close-up view of the device as shown in FIG. 14.
FIG. 14C is a close-up view of the device as shown in FIG. 14.

FIG. 14 is an alternate embodiment of another version of the device wherein front wall 80 is removable from side walls 50 and 60. Front wall 80 is removably affixed to side walls 50 and 60 by means of interlocking means similar to that shown in FIGS. 11, 12 and 13.

While the invention has been described with reference to specific embodiments, other modifications of the invention may be constructed and used without departing from the scope of the invention.

What is claimed:

1. An adjustable multi-compartmental recycling container, said container comprising:

two sets of parallel outer walls, joined together by a common base, with variably sized compartments; said compartments defined by variably placed vertical partition walls, means to engage said partition walls to a first set of said two sets of parallel outer walls of said container, said means being a plurality of nodules interlocking within corresponding receptacles, said receptacles being flexibly disposed to said partition walls by a hinge means, said hinge means includes:

a flexible extension joining said receptacle to said partition wall, said extension having a front face end indented by said receptacle, said receptacle being fitably disposed to a corresponding extending nodule extending from one of said outer walls of said container, said extension having a pair of opposite side walls extending rearward from said front face end, each of said opposite side walls having vertical grooves at an end away from said front face end, each of said side walls being flexibly joined adjacent to each of said grooves to an edge of each of said outer walls, said extension being rotatably movable left and right about said grooves for easy detachment of said nodules from said receptacles.

* * * * *